US005203390A

United States Patent [19]

Eckstein

[11] Patent Number: 5,203,390

[45] Date of Patent: Apr. 20, 1993

[54] COVER FOR PROTECTING GOLF CLUB HANDLES AND THE LIKE

[75] Inventor: David L. Eckstein, Cary, N.C.

[73] Assignee: Kilf Designs, Inc., Cary, N.C.

[21] Appl. No.: 742,755

[22] Filed: Aug. 8, 1991

[51] Int. Cl.[5] ..... A63B 53/14; A63B 57/00

[52] U.S. Cl. ..... 150/160; 16/DIG. 12; 273/81 R

[58] Field of Search ..... 150/156, 160, 161; 16/116 R, 116 A, DIG. 12; 273/81 R, 81 D, 32 R, 32 E, 165, 75, DIG. 30; 74/558, 558.5

[56] References Cited

U.S. PATENT DOCUMENTS

| | | | |
|---|---|---|---|
| 587,956 | 8/1897 | Rawlings et al. | 16/DIG. 12 X |
| 1,617,972 | 2/1927 | Wallace | 273/81 R X |
| 1,886,464 | 11/1932 | Bright | 150/160 |
| 2,984,486 | 5/1961 | Jones | 273/75 X |
| 2,997,042 | 8/1961 | Mitchell | 273/81 R X |
| 3,147,012 | 9/1964 | Sullivan, Jr. | 273/165 |
| 3,397,891 | 8/1968 | Koch | 273/165 X |
| 3,766,954 | 10/1973 | Gentellalli . | |
| 4,098,506 | 7/1978 | Gaiser | 273/81 R X |
| 4,133,529 | 1/1979 | Gambino | 273/81 R |
| 4,159,115 | 6/1979 | Ticktin et al. | 273/81.5 X |
| 4,651,991 | 3/1987 | McDuff | 273/75 |
| 4,662,415 | 5/1987 | Proutt | 150/160 |
| 4,967,454 | 11/1990 | Elieff | 24/712.1 |
| 4,988,216 | 1/1991 | Lyman | 383/74 |

*Primary Examiner*—Sue A. Weaver

*Attorney, Agent, or Firm*—Bell, Seltzer, Park & Gibson

[57] ABSTRACT

A cover for protecting golf club handles and the like from moisture and perspiration prior to use thereof and which absorbs moisture is disclosed. The cover includes an elongate tubular member having a closed end and an opposing open end. The tubular member is dimensioned to form a sleeve adapted to fit over the handle. The sleeve includes an outer shell formed of a substantially waterproof material. An inner terry cloth fabric covers a substantial majority of the inside surface of the shell. A retainer, such as a drawstring, is positioned at the open end of the sleeve for retaining the open end into secure engagement to the handle of a golf club so that the sleeve can be retained onto the handle when secured thereon.

8 Claims, 2 Drawing Sheets

COVER FOR PROTECTING GOLF CLUB HANDLES AND THE LIKE

FIELD OF THE INVENTION

This invention relates to a cover for protecting golf club handles and the like from moisture and perspiration prior to use thereof, and for absorbing moisture from the handle.

BACKGROUND OF THE INVENTION

Golfers often find it difficult to maintain their golf club handle in playable condition. The handles must be clean and dry to ensure that the golfers maintain the desired grips when they are swinging. Because the game of golf is played outdoors in essentially all climates, rain, snow, perspiration or dirt may accumulate on the handles making the grip difficult to hold. As a result, golfers often must wipe or dry the handle grip to remove the moisture, perspiration or dirt. Unless towels are readily available, the golfers often must resort to using their pants or shirts as a towel. Not only is this practice inconvenient and uncomfortable, but also the use of pants or shirts for a towel is potentially embarrassing.

SUMMARY OF THE INVENTION

It is therefore an object of the present invention to provide a cover for protecting golf club handles and the like from moisture, perspiration, and dirt prior to use thereof, and that absorbs moisture from the handles. The cover can remain in protective covering to the handle at all times prior to use.

It is another object of the present invention to provide a cover for protecting golf club handles and the like from moisture, perspiration, and dirt prior to use thereof and that is simple in construction.

In accordance with the present invention, the cover provides protection to the handle from moisture, perspiration, and dirt prior to use thereof and that absorbs moisture from the handle. The cover includes an elongate tubular member having a closed end and an opposing end. The tubular member is dimensioned to form a sleeve adapted to fit over the handle of a golf club. The sleeve includes an outer shell formed of a substantially waterproof material and an inner terry cloth fabric covering a substantial majority of the inside surface of the shell. Means is positioned at the open end of the sleeve for retaining the open end into secure engagement to the handle shaft of a golf club so that the sleeve can be retained onto the handle when secured thereon.

In one embodiment, the means for retaining the open end into secure engagement to the handle shaft includes hook and pile fasteners. In another embodiment the means for retaining the open end into secure engagement to the handle shaft includes snap fasteners.

In still another embodiment, the edge portions of the open end are folded over to form a drawstring channel and two channel openings. A drawstring is positioned within the channel and has drawstring ends extending from the openings. A locking means is included for locking the drawstring when the drawstring is pulled so that the cover remains in secure engagement to the handle shaft of a golf club when inserted thereon. The locking means preferably comprises a barrel member having a closed bottom and open top. A plunger member is slidably positioned in the top opening. Both the barrel and plunger members have aligned orifices extending therethrough. The ends of the drawstring extend through the orifices. A spring biases the plunger member relative to the barrel member so that the drawstring is caught between the barrel and plunger members and locked into position.

In another embodiment the retaining means positioned at the open end includes a flap member which can be folded over and secured onto the outer surface of the sleeve so that the flap member engages the handle to retain the sleeve into secure engagement therewith. The terry cloth extends onto the flap member so that when the flap member is secured onto the outer surface of the sleeve, the terry cloth engages the golf club shaft.

The tubular member includes an outer, substantially waterproof shell made from preferably a nylon material. An inner terry cloth fabric covers a substantial majority of the inside surface of the shell. The outer shell is formed of a rectangular piece of substantially waterproof material having two substantially parallel, longitudinal edges and two opposing edges shorter than the longitudinal edges. The terry cloth is secured in overlying engagement to the piece of outer shell material. The longitudinal edges are joined together to form a sleeve with the terry cloth on the inside. The rectangular pieces are dimensioned so that the formed sleeve is adapted to fit over the grip of a golf club.

BRIEF DESCRIPTION OF THE DRAWINGS

Some of the objects and advantages of this invention having been set forth above, other objects and advantages will appear as the description proceeds, when taken in conjunction with the accompanying drawings, in which.

DETAILED DESCRIPTION OF THE INVENTION

Figure 1:
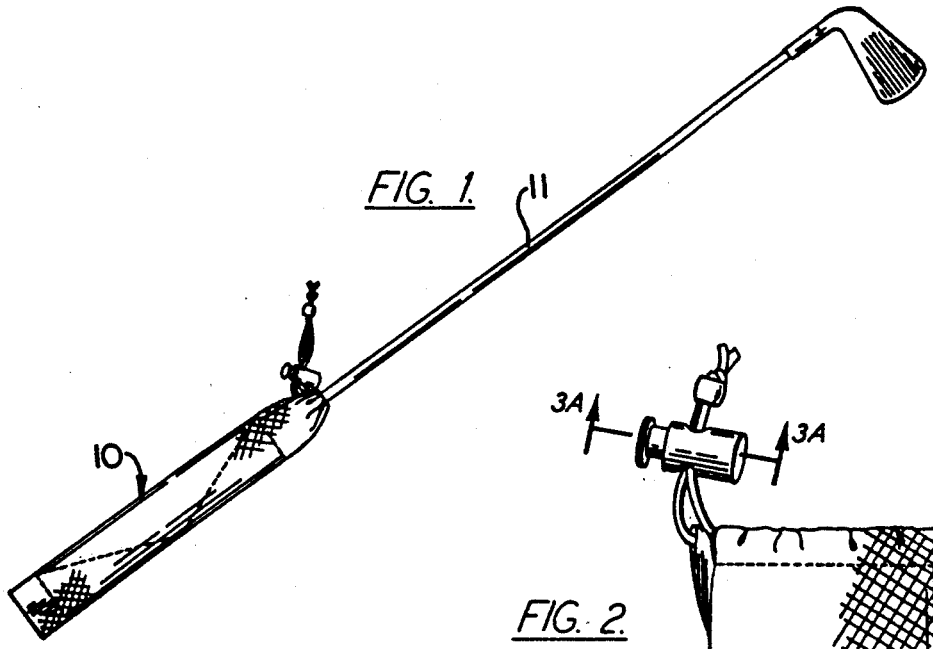
FIG. 1 is an isometric view of a golf club having the cover in accordance with one preferred embodiment of the present invention positioned over the handle.

Referring now to the drawings, and more particularly to FIG. 1, there is disclosed at 10 a cover in accordance with the present invention for protecting the handle of a golf club 11 and the like from moisture and perspiration prior to use thereof. Although the cover is illustrated in use with a golf club, the cover 10 can be dimensioned for use with different objects and tools where a handle must be protected from moisture, perspiration and dirt.

Figure 2:
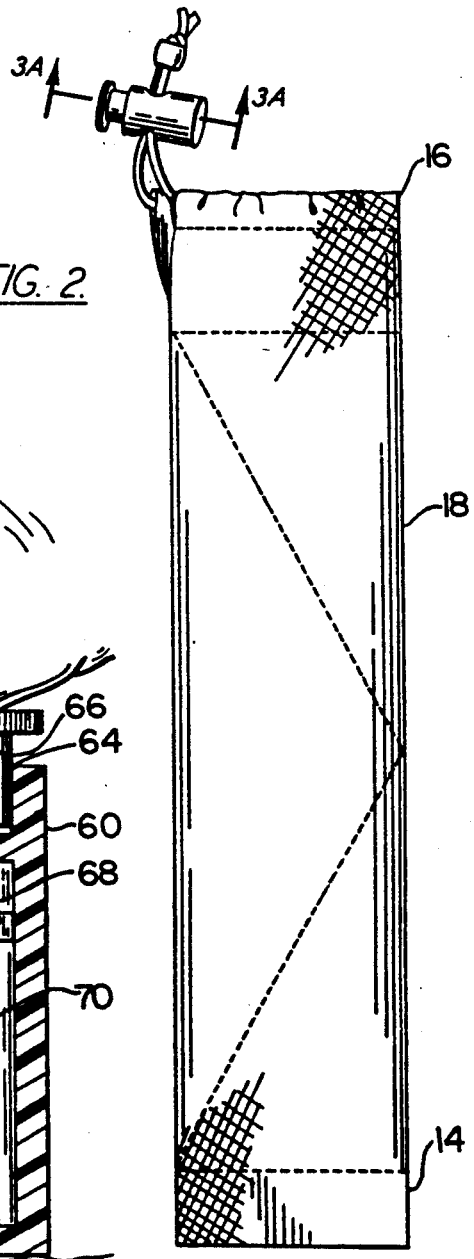
FIG. 2 is a plan view of the cover of FIG. 1.

As shown in FIG. 2, the grip cover is formed as an elongate tubular member having a closed end 14 and an opposing open end 16. The tubular member is dimensioned to form a sleeve adapted to fit over the handle of a golf club and the like.

The formed tubular member sleeve includes an outer shell 18 formed of a substantially waterproof material. Preferred materials include Nylon and other materials that are substantially waterproof and resist moisture, perspiration, and dirt. The outer shell 18 is formed from a rectangular piece of the waterproof material 20 (FIG. 4) and has two substantially parallel longitudinal edges 22, 24 and two opposing edges 26, 28 shorter than the longitudinal edges.

Figure 4:
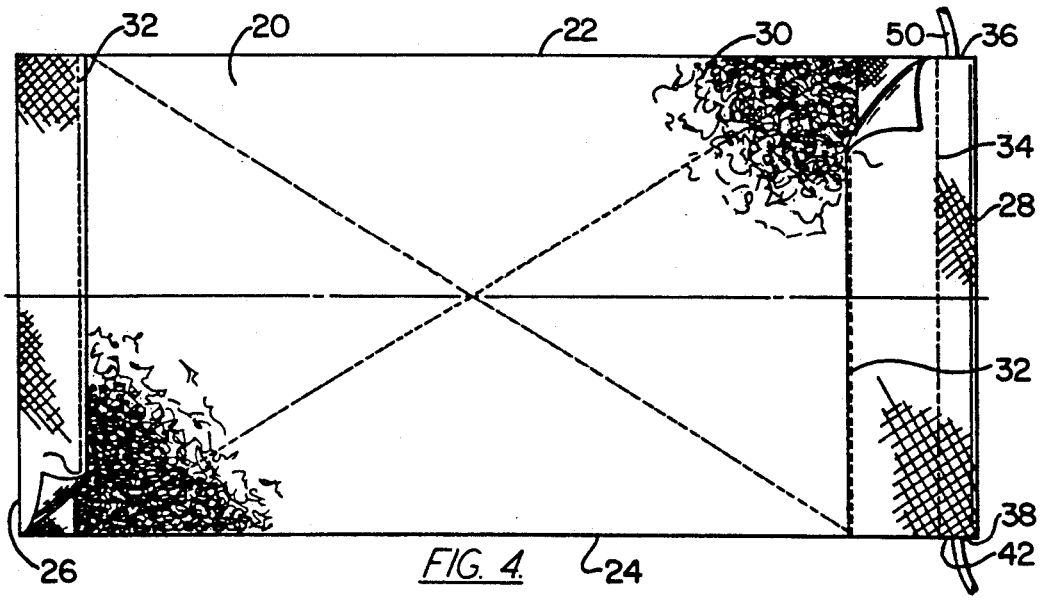
FIG. 4 is a plan view of the material forming the outer shell and inner terry cloth lining of the cover before the longitudinal edges are stitched together.

A piece of terry cloth is secured in overlying engagement to the outer shell of the material so that the terry cloth covers a substantial area of the outer shell. As illustrated, both ends 26, 28 are folded upon themselves and stitched along a longitudinal stitch line 32 to aid in securing the terry cloth to the outer shell 18. Additionally, the terry cloth 30 can be secured to the outer sleeve 18 by an adhesive. As illustrated in FIG. 4, the edge 28 is folded and includes a second stitch line 34 adjacent the edge 28 to form a drawstring channel and two channel openings 36, 38.

The longitudinal edges 22, 24 are joined and knit together to form the elongate tubular sleeve with the terry cloth positioned on the inside. The shorter end 26 is stitched together to form the closed end 14 of the cover. The other, open end 16 includes means positioned thereat for retaining the open end into secure engagement to the handle shaft of the golf club so that the sleeve is retained onto the handle when inserted thereon. In the illustrated embodiment of FIGS. 2 and 4, the retaining means includes a drawstring 50 positioned within the drawstring channel and having drawstring ends emerging from the openings 36, 38.

Figure 3A:
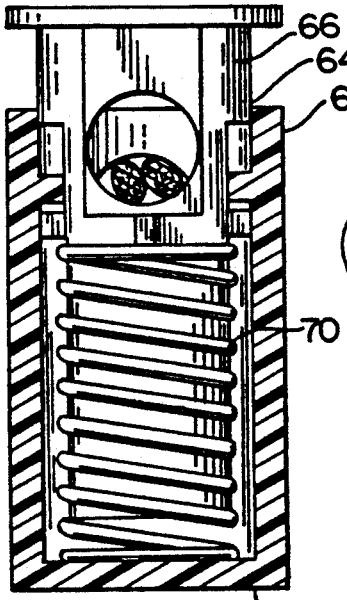
FIGS. 3A and 3B show the operation of the drawstring lock in accordance with one preferred embodiment of the present invention.
Figure 3B:
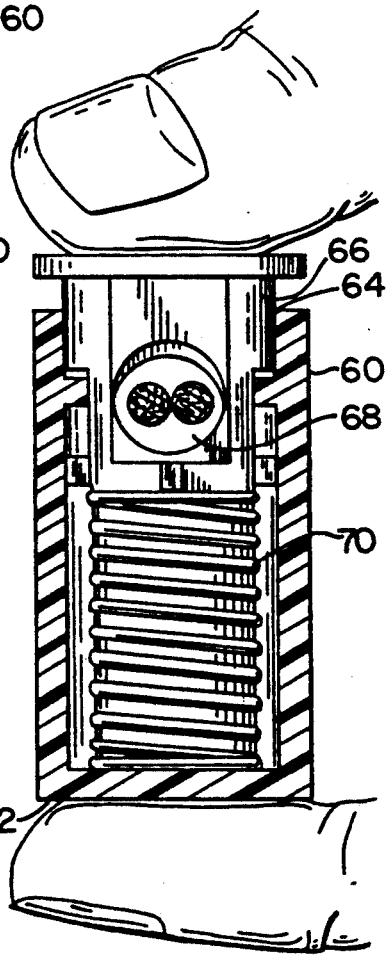

When the cover is placed onto the handle of a golf club 11, the drawstring 50 is pulled and the open end is tightened against the shaft of the golf club to retain the cover on the handle. Means for locking the drawstring when pulled includes a barrel member 60 (FIGS. 3A and 3B) having a closed bottom 62 and an open top 64. A plunger member 66 is slidably positioned in the top opening 64. Both the barrel and plunger members 60, 66 have aligned orifices 68 extending through the members. The ends of the drawstring 50 extend through the orifices 68. A spring 70 receives the end of the plunger 66. The end of the spring 70 engages the bottom 62 of the barrel. The spring 70 biases the plunger member 66 upward relative to the barrel so that the drawstring 50 is caught between the barrel and plunger members 60, 66 and locked into position.

Figure 5:
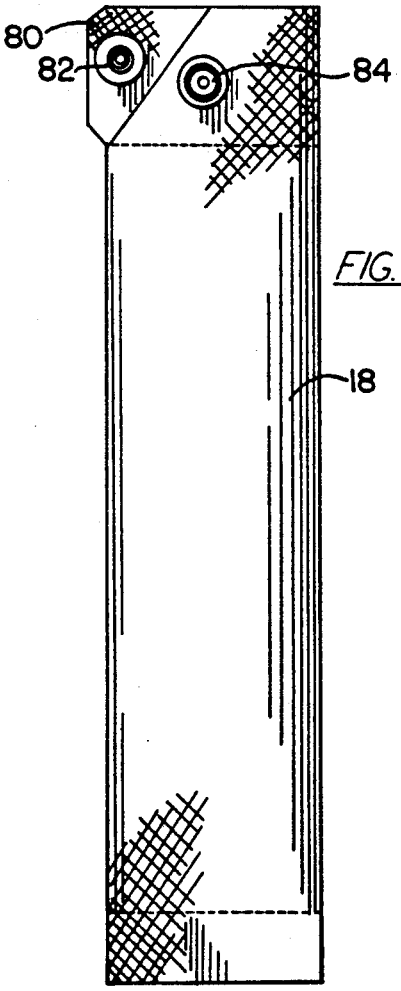
FIG. 5 is a plan view of the grip cover in accordance with another embodiment of the present invention and showing a flap member positioned at the open end of the sleeve and retaining means in the form of a snap fastener.
Figure 6:
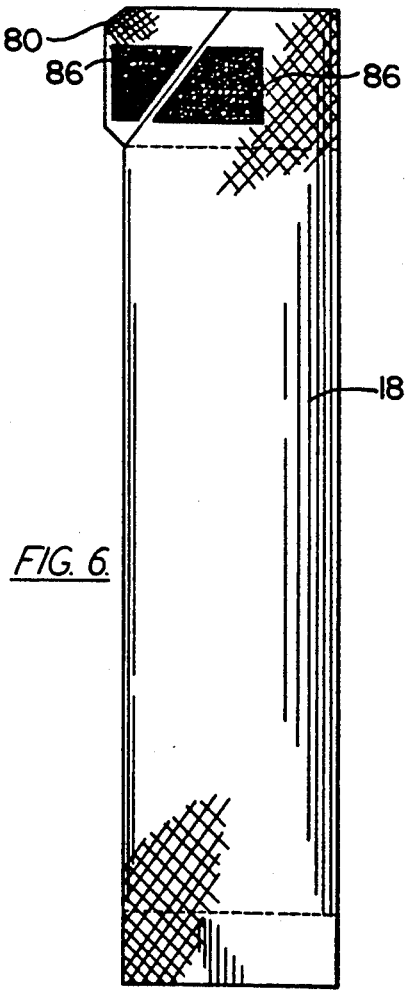
FIG. 6 is a plan view of the grip cover in accordance with another embodiment of the present invention and showing a flap member positioned at the open end of the sleeve and retaining means in the form of hook and pile fasteners.

In other embodiments illustrated in FIGS. 5 and 6, the cover includes a flap member 80 which can be folded over and secured onto the outer surface of the sleeve so that the flap member engages the handle to retain the sleeve into secure engagement therewith. Preferably terry cloth extends onto the flap member so that when the flap member is secured onto the outer surface of the sleeve 18 the terry cloth 30 engages the golf club shaft 11. Means for retaining the open end into secure engagement to the handle shaft in the embodiment of FIG. 5 includes a male snap fastener 82 positioned on the flap member 80 for connecting the female member snap fastener member 84 positioned on the outer sleeve.

In the embodiment of FIG. 6, the flap member so and outer surface of the sleeve 18 includes pile and hook fastener means 86, sold under the trade name Velcro. Other fastening means can include zippers or elastic bands.

The cover in accordance with the present invention protects golf club handles and the like from moisture, perspiration, dirt, and other contaminants. When a golfer is not using a club, the cover is positioned over the handle and tightened thereto by one of the illustrated fastening means. When the golfer is ready to use a particular club, the golfer twists, slightly the cover, allowing the terry cloth to wipe and absorb any perspiration, moisture, dirt, or other contaminants that are present on the handle. The fastening means is unlocked and the cover removed. The golfer now has a clean grip.

In the drawings and specification, there has been set forth a preferred embodiment of the invention, and although specific terms are employed, they are used in a generic and descriptive sense only and not for purposes of limitation.

That which is claimed is:

1. A cover for protecting golf, club handles comprising an elongate tubular member having a closed end and an opposing open end, the tubular member being dimensioned to form a sleeve adapted to fit over the handle, and wherein the sleeve includes an outer shell formed of a substantially waterproof material, and an inner terry cloth fabric covering a substantial majority of the inside surface of the shell, and wherein the edge portion of the open end is folded upon itself to form a drawstring channel and two channel openings, a drawstring positioned within the channel and having drawstring ends emerging from the openings, and means for locking the drawstring when the drawstring is pulled so that the grip cover remains in secure engagement to the handle of a golf club when inserted thereon.

2. A cover according to claim 1 wherein the means for locking the drawstring when pulled comprises a barrel member having a closed bottom and open top, a plunger member slidably positioned in the top opening, both the barrel and plunger members having aligned orifices extending therethrough, the ends of the drawstring extending through the orifices, and means interconnecting the plunger and barrel members for biasing the plunger member relative to the barrel so that the drawstring is caught between the barrel and plunger members and locked into position.

3. A cover for protecting golf, club handles comprising an elongate tubular member having a closed end and an opposing open end, and wherein the tubular member includes an outer, substantially waterproof shell and an inner terry cloth fabric covering a substantial majority of the inside surface of the shell, ad wherein the outer shell is formed of a rectangular piece of substantially waterproof material having two substantially parallel, longitudinal edges and two opposing edges shorter than the longitudinal edges, and wherein the terry cloth is secured in overlying engagement to the piece of outer shell material, the longitudinal edges being joined together to form a sleeve with a terry cloth on the inside, the rectangular piece being dimensioned so that the formed sleeve is adapted to fit over the handle, one end of the formed sleeve being secured together to form a closed end, and means positioned at the other open end for retaining the open end into secure engagement t the handle so that the sleeve is retained onto the handle when inserted thereover.

4. A cover according to claim 3 wherein the edge defining the open end of the sleeve is folded upon itself to form drawstring channel and channel openings, and the means for retaining the open end into secure engagement comprises a drawstring positioned within the drawstring channel.

5. A cover according to claim 3 wherein the retaining means at the open end of the formed sleeve includes a flap member which can be folded over and secured onto the outer surface of the sleeve so that the sleeve is retained onto the handle.

6. A cover according to claim 5 wherein the retaining means includes hook and pile fastener means positioned on the flap member and the outer surface of the sleeve.

7. A cover according to claim 5 wherein the retaining means includes snap fastener means positioned on the flap member and the outer surface of the sleeve.

8. A cover according to claim 5 wherein the terry cloth extends over the flap member so that when the flap member is secured onto the outer surface of the sleeve, the terry cloth engages the golf club shaft.

* * * * *

UNITED STATES PATENT AND TRADEMARK OFFICE

CERTIFICATE OF CORRECTION

PATENT NO. : 5,203,390

DATED : April 20, 1993

INVENTOR(S) : David L. Eckstein

It is certified that error appears in the above-identified patent and that said Letters Patent is hereby corrected as shown below:

Column 3, line 35, "38", should be --28--.

Column 3, line 66, "so", should be --80--.

Column 4, line 64, "t", should be --to--.

Signed and Sealed this

First Day of February, 1994

Bruce Lehman

*Attest:*

BRUCE LEHMAN

*Attesting Officer*

*Commissioner of Patents and Trademarks*